US007360348B2

(12) United States Patent
Ishii et al.

(10) Patent No.: US 7,360,348 B2
(45) Date of Patent: Apr. 22, 2008

(54) METHOD FOR CONTROLLING MANUFACTURE OF A SHEET MATERIAL

(75) Inventors: Yoshiyuki Ishii, Shizuoka-ken (JP); Hiroyuki Nishida, Shizuoka-ken (JP)

(73) Assignee: Fujifilm Corporation, Kanagawa (JP)

( * ) Notice: Subject to any disclaimer, the term of this patent is extended or adjusted under 35 U.S.C. 154(b) by 0 days.

(21) Appl. No.: 10/725,417

(22) Filed: Dec. 3, 2003

(65) Prior Publication Data

US 2004/0154270 A1 Aug. 12, 2004

(30) Foreign Application Priority Data

Dec. 4, 2002 (JP) ..... 2002-352255

(51) Int. Cl.
*B65B 1/30* (2006.01)

(52) U.S. Cl. ..... 53/498; 53/493; 53/54; 53/435

(58) Field of Classification Search ..... 53/54, 53/493, 494, 498, 435; 493/12–15, 17, 20
See application file for complete search history.

(56) References Cited

U.S. PATENT DOCUMENTS 3,445,981 A * 5/1969 Hori ..... 53/450
3,578,311 A * 5/1971 Wood et al. ..... 493/13
3,584,545 A * 6/1971 Ehlscheid ..... 493/12
3,657,858 A * 4/1972 Bossons et al. ..... 53/493
3,797,372 A * 3/1974 Shelmire ..... 493/13
4,137,528 A * 1/1979 Traise ..... 340/675
4,416,651 A * 11/1983 Sullivan et al. ..... 493/12
4,496,337 A * 1/1985 Meenen ..... 493/14
4,649,691 A * 3/1987 Buckholz ..... 53/53
4,912,554 A * 3/1990 Neri ..... 348/125
5,081,816 A * 1/1992 Cardinali ..... 53/54
5,123,231 A * 6/1992 Fallas et al. ..... 53/493
5,240,117 A * 8/1993 Focke et al. ..... 209/536
5,507,134 A * 4/1996 Takeda et al. ..... 53/531
5,881,532 A * 3/1999 Kitagawa ..... 53/54
5,970,682 A * 10/1999 Focke et al. ..... 53/53
6,345,208 B1 * 2/2002 Yoshiyuki ..... 700/97
6,363,686 B1 * 4/2002 Heide ..... 53/53
6,820,399 B2 * 11/2004 Send ..... 53/471

FOREIGN PATENT DOCUMENTS

JP 7-49197 B2 5/1995
JP 9-124200 A 5/1997
JP 2001-93026 A 4/2001

* cited by examiner

*Primary Examiner*—Sameh H. Tawfik
(74) *Attorney, Agent, or Firm*—Birch, Stewart, Kolasch & Birch, LLP

(57) ABSTRACT

A sorting and conveying line provided at an X-ray film cutting and collection operation includes a defective sheet gate, a collection gate and a sample gate for sorting X-ray film sheets, which have been cut to a predetermined size at a cutting section, while the X-ray film sheets are conveyed. Film detection sensors are disposed at entrance and exit sides of each of the defective sheet gate, the collection gate and the sample gate, and each film detection sensor detects the X-ray film sheet at times when the X-ray film sheet should be conveyed and sorted. Based on the results of detection, a determination is made as to whether or not there is any failure in control on a number of produced X-ray film sheets, and the like, as well as conveyance and sorting operations. This allows smooth and quick handling in the event of a failure.

9 Claims, 5 Drawing Sheets

METHOD FOR CONTROLLING MANUFACTURE OF A SHEET MATERIAL

CROSS-REFERENCE TO RELATED APPLICATION

This application claims priority under 35 USC 119 from Japanese Patent Application No. 2002-352255, the disclosure of which is incorporated by reference herein.

BACKGROUND OF THE INVENTION

1. Field of the Invention

The present invention relates to a processing apparatus for processing sheet materials as products by performing operations such as collection, wrapping, and the like, while conveying the sheet materials. More particularly, the present invention relates to a method and a system for controlling manufacture of a sheet material at a processing apparatus, or the like.

2. Description of the Related Art

Photosensitive materials include X-ray films for medical use, which are produced by forming a heat developing photosensitive material into sheets. Such X-ray film sheets are manufactured by cutting a whole film (raw film roll) to a predetermined width, and then to a predetermined length, so that the film sheets have a predetermined size.

Thereafter, a predetermined number of X-ray film sheets are collected and covered with a protective cardboard, and then is closely wrapped with a light-shielding moisture-proof wrapping material to form a wrapped body for shipment. Further, the wrapped body is put, for example, in a carton to prepare a package for shipment.

In an X-ray film processing process, a branch gate is provided on a conveyance line, and if a defective product is detected, the defective product is separated at the branch gate to be removed. During the X-ray film processing process, sampling is performed for checking quality of the X-ray film sheets. For this purpose, a sampling branch gate is also provided on the conveyance line, and a sample X-ray film sheet is removed by changing a conveyance path or a collection point using the branch gate.

That is, there are the branch gates provided on the conveyance line of the processing process of the X-ray film, and the X-ray film sheets are collected while being sorted by the branch gates.

In order to manufacture such X-ray film sheets, a manufacturing system has been proposed, in which respective operations including from setting a whole film in a processing process to cutting X-ray film sheets from the whole film and wrapping them, are automated to be controlled (see, for example, Japanese Patent Application Laid-Open (JP-A) No. 9-124200).

In the above manufacturing system, a number of cuttings of sheet materials performed by a cutter, or the like, a number of sheet materials sorted into an ejection tray, a number of sheet materials for sampling, and a number of sheet materials collected for productization (packaging) are counted, and the counted values are respectively recorded for each lot or each whole film for manufacture control. Further, it is checked that if the number of cuts agrees with a sum of the number of products, the number of ejected sheets and the number of samples.

If the number of produced sheets and the number of collected sheets do not agree with each other and excess or deficiency is caused, a follow-up check is necessary. At this time, if the quantities are checked for each lot or each whole film, there is a problem that, even if excess or deficiency (disagreement) is detected, for example, between the number of produced sheets and the number of collected sheets, response to it is delayed. Specifically, if there is excess or deficiency in the resulted counts, a missing sheet material will be searched for with the help of any clues such as a failure in the equipment. If the numbers are counted for each lot or each whole film, the deficiency, for example, may be mixed up in a sampling tray or in an ejection tray, as well as in products packaged for shipment.

This causes delay in detection of the excess or deficiency, making the follow-up check complicated. Further, efficiency of various operations is lowered, such that production efficiency is lowered by stopping manufacture for the follow-up check.

SUMMARY OF THE INVENTION

In view of the aforementioned, an object of the present invention is to propose a method and system for controlling manufacture of a sheet material, which allows an appropriate and quick control during manufacturing a sheet material such as an X-ray film.

In order to accomplish the above-described object, an aspect of the invention is a method for controlling manufacture of a sheet material in which the sheet material or a processed product of the sheet material is manufactured by processing the sheet material or performing predetermined operations on the processed sheet material at each of processing operations or processing sections provided at the processing operations while conveying the sheet material along a predetermined line, the method comprising: detecting the sheet material or the processed product of the sheet material by sheet material detectors disposed at entrance and exit sides of each of the processing operations or the processing sections where the sheet material or the processed product of the sheet material enters and exits the processing operations or the processing sections; and controlling conveyance or manufacture of the sheet material or the processed product of the sheet material based on results of detection by the sheet material detectors.

According to this aspect of the invention, sheet material detectors for detecting the sheet material or a processed product of the sheet material are disposed at entrance and exit sides of each of processing operations for processing the sheet material, and of each of processing sections, such as a branch section for sorting the sheet material, provided at the processing operations. When there are a plurality of entrance sides and/or exit sides at one processing operation or processing section, each of the entrance and exit sides is provided with a sheet material detector.

Using the sheet material detectors positioned as described above, and comparing (matching), for example, results of detection by the sheet material detectors at the entrance and the exit sides of each processing operation or processing section, precise determination can be made on whether or not the sheet material is properly conveyed, and the like. Thus, quality of the products being conveyed, and the like, can be quickly detected.

Further, by tallying up the results of detection at the sheet material detectors at the exit sides, output, production efficiency, and the like, at each processing operation or processing section can be precisely grasped.

Another aspect of the invention is a system for controlling manufacture of a sheet material provided for a sheet material processing process which includes a sorting operation where the sheet material is conveyed along a conveyance line and is collected while being sorted at a branch gate disposed at the conveyance line, the system comprising: sheet material detectors disposed respectively at entrance and exit sides of the branch gate for detecting the sheet material fed into the branch gate or passed through the branch gate; and a determination section for determining if any failure has occurred in at least one of conveyance and sorting of the sheet material, based on results of detection by the sheet material detectors.

According to the above aspect, where the sheet material is sorted and collected using the branch gate provided at the conveyance path while the sheet material is conveyed, each of the exit sides, as well as the entrance side, of the branch gate is provided with a sheet material detector.

When the sheet material passes through the gate, the sheet material detector at the entrance side first detects the sheet material, and then, one of the sheet material detectors at the exit sides detects the sheet material. Therefore, usually, a sum of the numbers of the sheet materials detected by the detectors at the exit sides agrees with the number of the sheet materials detected by the detector at the entrance side. However, in the event of any abnormality, they do not agree with each other.

Accordingly, the determination section determines if any failure has occurred in the system based on results of detection by the sheet material detectors disposed at opposite sides of the branch gate.

This allows quick detection of a failure, and smooth and precise handling of the failure. This also facilitates search of a missing sheet material, and therefore can prevent a down time from being prolonged and production efficiency from being lowered.

When there are three or more branch paths provided in the above aspect, each branch path may be provided with a sheet material detector.

When the manufacture control system includes a plurality of branch gates, it is preferable that each of entrance and exit sides of each branch gate is provided with a sheet material detector. This allows detection of a failure between branch gates, as well as a failure at a branch gate.

The system for controlling manufacture of a sheet material of the above aspect can be arranged such that at least conveyance of the sheet material along the conveying line is stopped based on a result of determination made at the determining section.

Thus, according to the invention, operation of the equipment is stopped when the determining section has determined that a failure occurred. This can prevent spreading of the failure and allow smooth and precise handling of the failure.

Further, where a processing operation for producing the sheet material by cutting a long material, which is wound in a roll, to a predetermined length is provided, the system for controlling manufacture of a sheet material includes a calculation section for calculating a number of produced sheet materials based on a length of the material drawn out from the roll, and the system can be arranged such that a number of the collected sheet materials at each destination of the branch gate is collated (matched) with the number of produced sheet materials calculated at the calculation section when conveyance of the sheet material is stopped.

According to this arrangement, when occurrence of a failure is determined, a number of produced sheet materials is collated (matched) with a number of collected sheet materials. Thus, one can quickly determine if there is any missing sheet material which has not been properly collected.

Moreover, where a plurality of processing operations for wrapping and packaging the sheet materials, which have been sorted and collected in the sorting operation, are provided, the system for controlling manufacture of a sheet material can include counting sections for counting numbers of products at the respective processing operations. Thus, the number of products at each of the processing operations, which is counted by each of the counting sections, can be checked at a predetermined timing.

According to this arrangement, a number of products at each of the processing operations is counted, and a result of count is checked. Thus, when there is any missing product, the fact can be clearly recognized, and an operator can quickly deal with a cause of the deficiency.

Since the numbers of products at the respective processing operations including from cutting a long material into sheets to wrapping and packaging can be grasped in the system for controlling manufacture of a sheet material of the invention, an output and production efficiency of the sheet material can be precisely grasped.

DETAILED DESCRIPTION OF THE INVENTION

Figure 1:
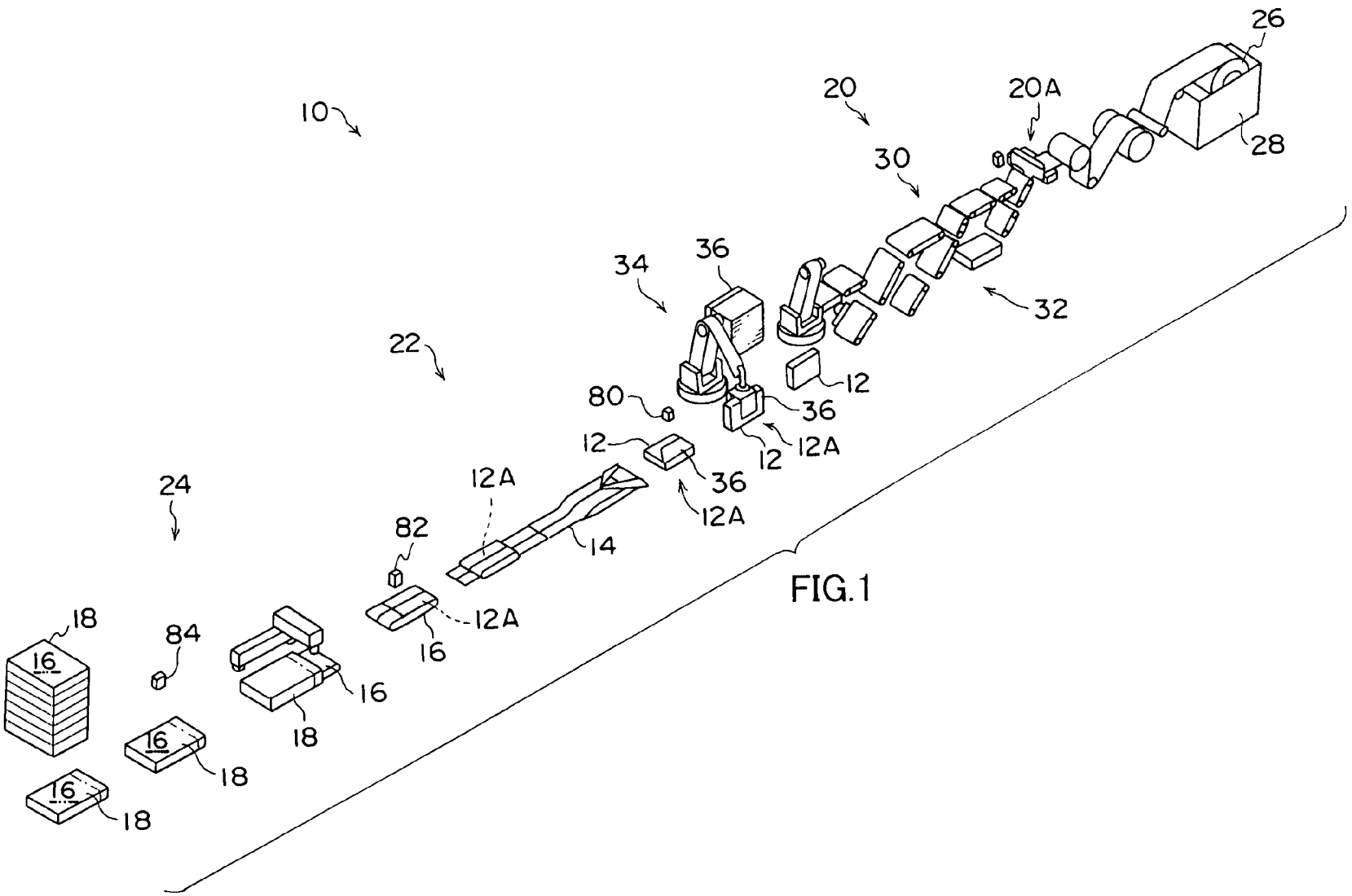
FIG. 1 is a schematic illustration showing a configuration of a film manufacturing system to which an embodiment of the present invention is applied.

Hereinafter, an embodiment of the present invention is described with reference to the drawings. FIG. 1 shows a schematic configuration of a film manufacturing system 10 applied to the present embodiment.

In the film manufacturing system 10, an X-ray film, which is one of heat developing photosensitive materials, is processed into sheets having a predetermined size (hereinafter, the X-ray film in a sheet form is referred to as "X-ray film sheet 12"), a predetermined numbers of X-ray film sheets 12 are bundled and wrapped with a light-shielding wrapping material 14 to form a wrapped body 16. In the film manufacturing system 10, the wrapped body 16 is packed in a carton 18 to form a product package for shipment. That is, in this embodiment, the X-ray film sheet 12 is applied as a sheet material.

The film manufacturing system 10 comprises a cutting and collecting operation 20, a moisture-proof wrapping operation 22 and a box packing operation 24.

At the cutting and collecting operation 20, a whole X-ray film or a portion of the X-ray film drawn from the whole film, which has been slit to a predetermined width and is taken up into a roll (hereinafter referred to as "roll 26"), is loaded with being mounted on the skid 28. Further, the cutting and collecting operation 20 includes a cutting section 20A such as a cutter.

At the cutting and collecting operation 20, the X-ray film is drawn from an outer circumferential end of the roll 26 of a predetermined width, which is mounted on the skid 28, and the X-ray film is cut to a predetermined length at the cutting section 20A. Thus, an X-ray film sheet 12 having a predetermined size is formed.

It should be noted that, in a structure where a whole X-ray film is mounted instead of the roll 26, a slitting section for slitting the X-ray film drawn from the whole film to a predetermined width is provided upstream from the cutting section 20A. Then, the cutting section 20A cut the X-ray film, which has been slit to the predetermined width by the slitting section, to a predetermined length.

A sorting and conveying line 30 is provided downstream from the cutting section 20A. The X-ray film sheet 12 is conveyed by the sorting and conveying line 30 and is collected at a predetermined point.

The cutting and collecting operation 20 includes a collecting section 32, where X-ray film sheets 12, which have been conveyed and sorted by the sorting and conveying line 30, are collected in a tray (not shown) in a set of a preset number (a number previously set according to a size of a package, such as 50-200 sheets).

The collecting section 32 includes an ejection tray for collecting, for example, X-ray film sheets 12 which correspond to tip and tail portions of the film drawn from the roll 26 as well as defective X-ray film sheets 12, which are detected to have some defect, and a sample tray for collecting sample X-ray film sheets 12, which are removed for sampling purposes. As described in detail later, the X-ray film sheets 12 are sorted and collected in the respective trays at the sorting and conveying line 30.

A protective cardboard attaching section 34 is provided at the downstream end of the cutting and collecting operation 20. Pieces of protective cardboard 36, which are previously formed into a predetermined shape by, for example, die cutting, are loaded in the protective cardboard attaching section 34. At the protective cardboard attaching section 34, the bundle of the predetermined number of X-ray film sheets 12, which have been collected at the collecting section 32 of the cutting and collecting operation 20, is covered with a piece of protective cardboard 36 to form a block 12A of the X-ray film sheets 12.

The block 12A of the X-ray film sheets 12 is sent to the moisture-proof wrapping operation 22. A roll (not shown) of moisture-proof wrapping material 14 is loaded in the moisture-proof wrapping operation 22. At the moisture-proof wrapping operation 22, first, the block 12A of the X-ray film sheets 12 is wrapped with the wrapping material 14 drawn out from the roll, and the wrapping material 14 is formed into a substantially tubular form.

Then, at the moisture-proof wrapping operation 22, the wrapping material 14 formed in a tubular form is cut at predetermined positions at opposite sides of the block 12A of the X-ray film sheets 12, and is joined to seal the block 12A of the X-ray film sheets 12 within the wrapping material 14.

Thereafter, at the moisture-proof wrapping operation 22, redundant portions (leading and trailing fillet portions) of the cut wrapping material 14 are folded, and labels (not shown) are adhered on the folded portions to form a wrapped body 16 of the sealed X-ray film sheets 12.

The wrapped body 16 is sent to the box packing operation 24. Cartons 18 for packaging the wrapped body 16 are loaded in the box packing operation 24. The wrapped body 16 sent to the box packing operation 24 is put in the carton 18 to be finished as a product for shipment.

Alternatively, in the film manufacturing system 10, a loading and storing operation may be provided downstream from the moisture-proof wrapping operation 22. In this case, for example, the wrapped body 16 may be once loaded in a magazine and stored, and taken out from the magazine at a predetermined time and fed to the box packing operation 24 to be loaded in the carton 18.

Figure 2:
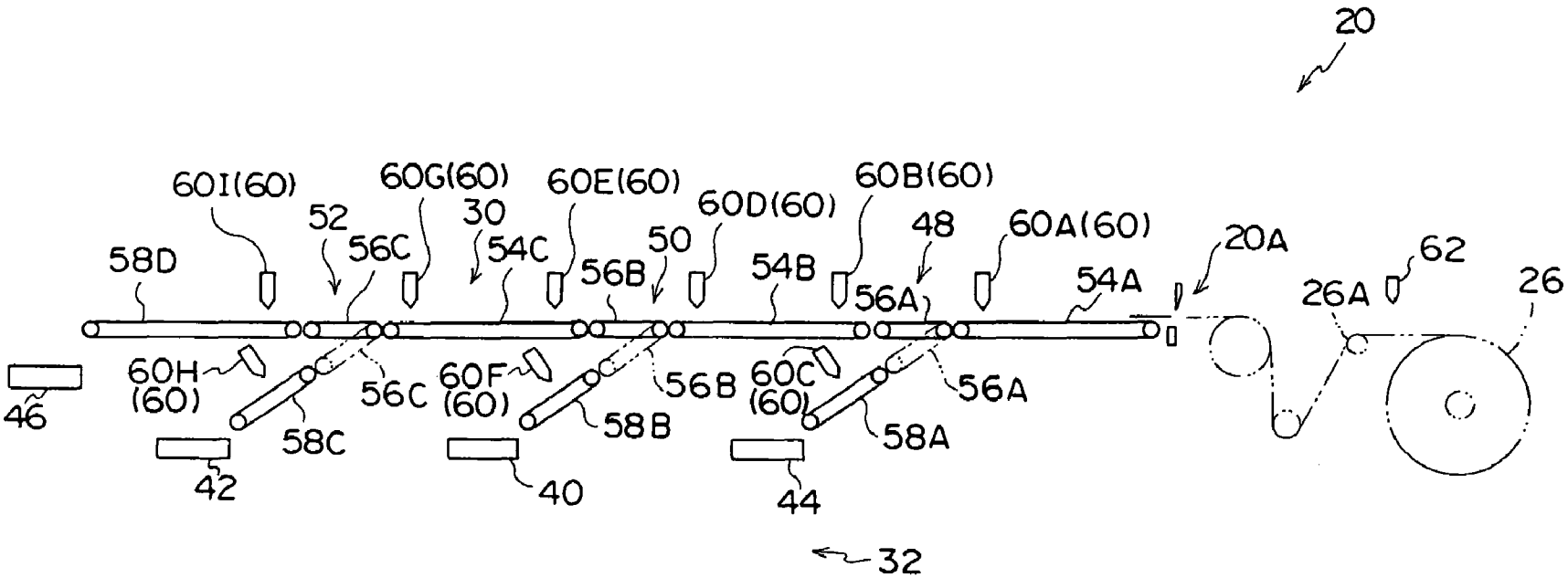
FIG. 2 is a schematic illustration showing a sorting and conveying line provided at a cutting and collecting operation in the film manufacturing system.

As shown in FIG. 2, at the collecting section 32 of the cutting and collecting operation 20, collection trays 40 and 42 for collecting the X-ray film sheets 12 for products (to be packaged), as well as an ejection tray 44 and a sample tray 46 are provided. It should be noted that, in this embodiment, description is made, as an example, of a case where the collection trays 40 and 42 are used for collecting the X-ray film sheets 12 simultaneously at two locations. However, the X-ray film sheets 12 for products (to be packaged) may be collected simultaneously at three or more locations. In other words, there may be provided three or more collection trays for collecting the X-ray film sheets 12 for products (to be packaged).

The sorting and conveying line 30 includes a defective sheet gate 48, a collection gate 50 and a sample gate 52. The defective sheet gate 48 is provided with a pivoting conveyer 56A disposed between conveyers 54A and 54B, so that the X-ray film sheet 12 conveyed by the conveyer 54A can be guided and conveyed by the pivoting conveyer 56A toward a branch conveyer 58A, which is disposed between the pivoting conveyer 56A and the ejection tray 44. Thus, the X-ray film sheet 12 is collected in the ejection tray 44 to be ejected.

The collection gate 50 is provided with a pivoting conveyer 56B disposed between conveyers 54B and 54C, so that the X-ray film sheet 12 conveyed by the conveyer 54B can be guided and conveyed by the pivoting conveyer 56B toward a branch conveyer 58B. Thus, the X-ray film sheet 12 is collected in the collection tray 40 for products (to be packaged).

The sample gate 52 is provided with a pivoting conveyer 56C disposed downstream from the conveyer 54C, so that the X-ray film sheet 12 can be guided and conveyed by the pivoting conveyer 56C toward a branch conveyer 58C, which is disposed between the pivoting conveyer 56C and the collection tray 42, or toward a branch conveyer 58D, which is disposed between the pivoting conveyer 56C and the sample tray 46.

In this manner, the X-ray film sheets 12 are guided at the sample gate 52 toward the branch conveyer 58C to be collected in the collection tray 42 for products (to be packaged), or guided toward the branch conveyer 58D to be collected in the sample tray 46 to be removed as samples (sampling).

The defective sheet gate 48, the collection gate 50 and the sample gate 52 are respectively provided with film detection sensors 60 for detecting passage of the X-ray film sheet 12 at entrance and exit sides thereof where the X-ray film sheet 12 enters and exits the gate.

Specifically, the defective sheet gate 48 is provided with a detection sensor 60A at the conveyer 54A side thereof, a film detection sensor 60B at the conveyer 54B side thereof, and a film detection sensor 60C at the branch conveyer 58A side thereof.

Thus, detection can be effected of the X-ray film sheet 12 fed from the conveyer 54A to the defective sheet gate 48 (the pivoting conveyer 56A), the X-ray film sheet 12 passing through the defective sheet gate 48 and conveyed by the conveyer 54B, and the X-ray film sheet 12 passing through the defective sheet gate 48 and conveyed by the branch conveyer 58A to be collected in the ejection tray 44.

The collection gate 50 is provided with a film detection sensor 60D at the conveyer 54B side thereof, a film detection sensor 60E at the conveyer 54C side thereof, and a film detection sensor 60F at the branch conveyer 58B side thereof.

Thus, detection can be effected of the X-ray film sheet 12 fed from the conveyer 54B to the collection gate 50 (the pivoting conveyer 56B), the X-ray film sheet 12 passing through the collection gate 50 and conveyed by the conveyer 54C, and the X-ray film sheet 12 passing through the collection gate 50 and conveyed by the branch conveyer 58B to be collected in the collection tray 40.

The sample gate 52 is provided with a film detection sensor 60G at the conveyer 54C side thereof, a film detection sensor 60H at the branch conveyer 58C side thereof, and a film detection sensor 60I at the branch conveyer 58D side thereof.

Thus, detection can be effected of the X-ray film sheet 12 fed from the conveyer 54C to the sample gate 52 (the pivoting conveyer 56C), the X-ray film sheet 12 passing through the sample gate 52 and conveyed by the branch conveyer 58C to be collected in the collection tray 42, and the X-ray film sheet 12 passing through the sample gate 52 and conveyed by the branch conveyer 58D to be collected in the sample tray 46.

Further, at the cutting and collecting operation 20, a film detection sensor 62 is provided for detecting a length of the X-ray film sheet 12 drawn from the roll 26.

It should be noted that any of conventionally known sensors, such as reflective sensors utilizing light having a wavelength out of a wavelength range to which the X-ray film is sensitive, can be used as the film detection sensors 60 (60A to 60I).

Figure 3:
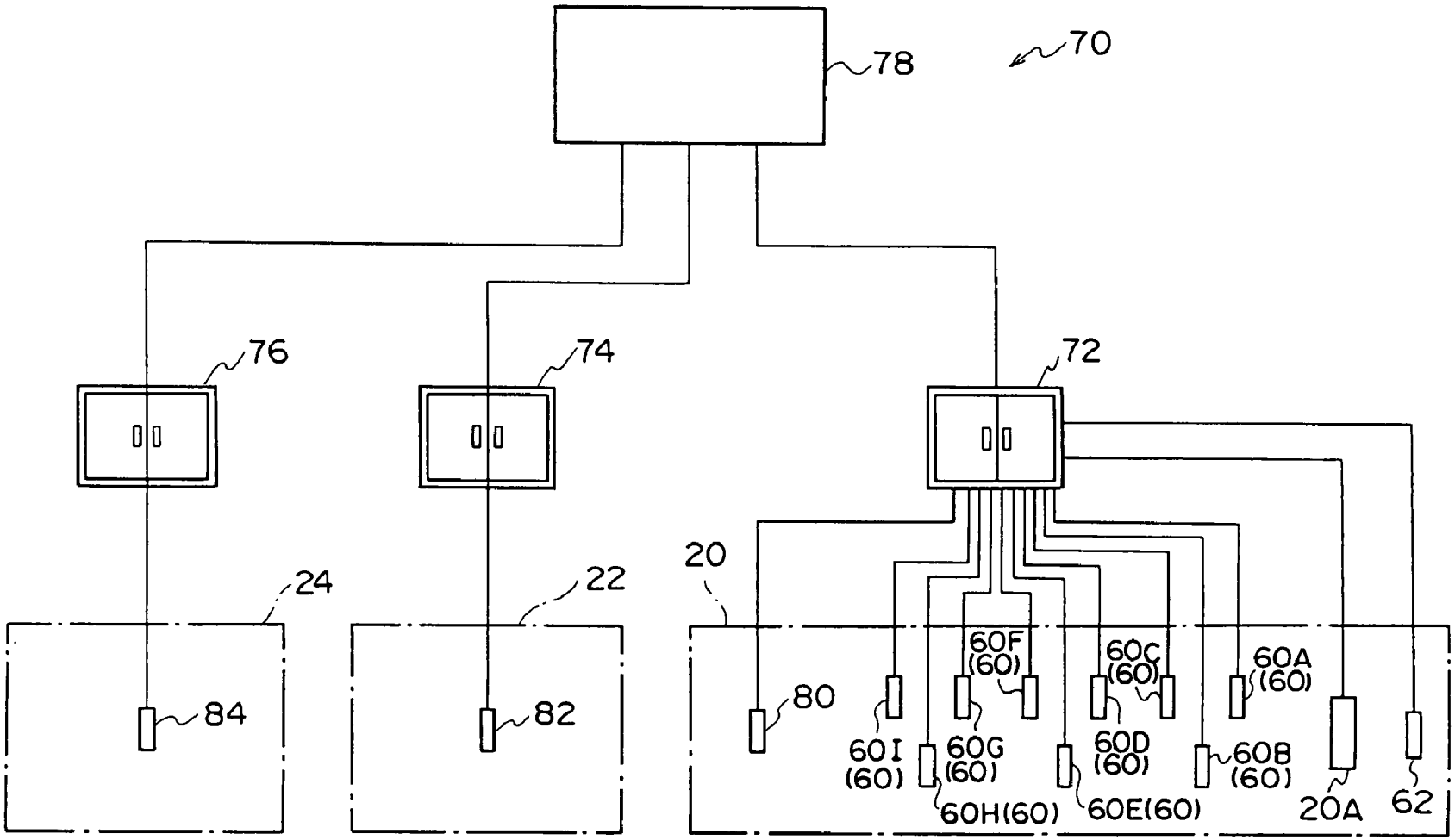
FIG. 3 is a schematic illustration showing a count control system provided as a manufacture control system in the film manufacturing system.

As shown in FIG. 3, a count control system 70 is formed in the film manufacturing system 10. The film manufacturing system 10 includes a cutting and collection control device 72 for controlling operation of respective devices at the cutting and collecting operation 20, a moisture-proof wrapping control device 74 for controlling operation of respective devices at the moisture-proof wrapping operation 22, and a box packing control device 76 for controlling operation of respective devices at the box packing operation 24.

The film manufacturing system 10 further includes a manufacture control computer 78. The cutting and collection control device 72, the moisture-proof wrapping control device 74 and the packing control device 76 are respectively connected to the manufacture control computer 78, thereby forming a control system for controlling processing and productization of the X-ray film sheets 12 in the film manufacturing system 10.

The film detection sensors 60 (60A to 60I) disposed along the sorting and conveying line 30 of the cutting and collecting operation 20, and the film detection sensor 62 are respectively connected to the cutting and collection control device 72.

Further, as shown in FIG. 1, the cutting and collecting operation 20 includes a counting sensor 80 for counting a number of the blocks 12A of the X-ray film sheets 12 produced at the cutting and collecting operation 20. The moisture-proof wrapping operation 22 includes a counting sensor 82 for counting a number of the wrapped bodies 16 produced at the moisture-proof wrapping operation 22. The box packing operation 24 includes a counting sensor 84 for counting a number of the cartons 18, which corresponds to a number of products produced at the box packing operation 24.

As shown in FIG. 3, the counting sensor 80 is connected to the manufacture control computer 78 via the cutting and collection control device 72, and the counting sensor 82 is connected to the manufacture control computer 78 via the moisture-proof wrapping control device 74. The counting sensor 84 is connected to the manufacture control computer 78 via the packing control device 76.

Thus, in the film manufacturing system 10, the manufacture control computer 78, the cutting and collection control device 72, the moisture-proof wrapping control device 74, the packing control device 76 and the counting sensors 80 to 84 form the count control system 70, so that the manufacture control computer 78 can control the number of produced X-ray film sheets 12, productivity, and the like.

At the cutting and collection control device 72 connected to the manufacture control computer 78, the X-ray film sheets 12 passing through the defective sheet gate 48, the collection gate 50 and the sample gate 52 can be checked (matched) using the film detection sensors 60.

Further, in the cutting and collection control device 72, a length of the film used to produce the X-ray film sheets 12 can be measured using the film detection sensor 62. Also, the number of produced X-ray film sheets 12 can be counted based on a number of operations of the cutting section 20A, or the like.

In the cutting and collection control device 72, a number of producible X-ray film sheets 12 can be calculated based on the length of the film, and the number of produced X-ray film sheets 12 can be calculated based on the number of operations of the cutting section 20A.

Moreover, in the cutting and collection control device 72, production efficiency of the X-ray film sheets 12 can be grasped based on the number of producible X-ray film sheets 12, the number of produced X-ray film sheets 12, and the number of actually produced X-ray film sheets 12 collected in the collection trays 40 and 42. It should be noted that the length of the film can be found based on a time period during which the film detection sensor 62 detects the X-ray film, and a rotation speed of a roll 26A (see FIG. 2) which contacts the X-ray film in the vicinity of the film detection sensor 62. However, any method can be applied to find the length of the X-ray film.

Further, at the manufacture control computer 78, the number of products at the cutting and collecting operation 20, the moisture-proof wrapping operation 22 and the box packing operation 24 can be respectively grasped and checked.

Operation of this embodiment will now be described.

In the film manufacturing system 10, the skid 28, on which the roll 26 of the film such as a whole X-ray film is mounted, is loaded in the cutting and collecting operation 20, and then, the X-ray film is drawn from the roll 26 and is cut by the cutting section 20A to the predetermined size to form the X-ray film sheets 12. The X-ray film sheets 12 are conveyed by the sorting and conveying line 30 to the collecting section 32, and are collected in sets of the predetermined number of sheets.

The bundle of the X-ray film sheets 12 collected at the collecting section 32 is taken out from the collecting section 32 and is conveyed to the protective cardboard attaching section 34, where a piece of protective cardboard 36 is attached thereto. In this manner, the block 12A of the X-ray film sheets 12 is produced.

The block 12A of the X-ray film sheets 12 produced at the cutting and collecting operation 20 is sent to the moisture-proof wrapping operation 22, where the block 12A is wrapped with the wrapping material 14.

In this manner, the wrapped body 16, in which the predetermined number of the X-ray film sheets 12 are sealed, is produced at the moisture-proof wrapping operation 22.

The wrapped body 16 produced at the moisture-proof wrapping operation 22 is sent to the box packing operation 24, where the wrapped body 16 is packed in the carton 18.

In this manner, the carton 18 containing the X-ray film sheets 12 is produced at the box packing operation 24.

The film manufacturing system 10 includes the count control system 70. The count control system 70 includes the manufacture control computer 78, which counts the number of products by counting the number of the blocks 12A of the X-ray film sheets 12 produced at the cutting and collecting operation 20, the number of the wrapped bodies 16 produced at the moisture-proof wrapping operation 22, and the number of cartons 18 containing the packed body produced at the box packing operation 24.

At the manufacture control computer 78, the numbers of products at the respective operations are checked at a predetermined time, such as at the end of operation of the film manufacturing system 10, so as to check if there is any missing product or not.

Specifically, checks are made as to whether there is any block 12A of the X-ray film sheets 12 which has not been wrapped at the moisture-proof wrapping operation 22 although it has been produced at the cutting and collecting operation 20, and whether there is any wrapped body 16 which has not been packed at the box packing operation 24 although it has been produced at the moisture-proof wrapping operation 22.

Such checks on products performed between the respective operations can be easily effected by checking whether or not a count value W1 at the counting sensor 80 disposed at the cutting and collecting operation 20, a count value W2 at the counting sensor 82 disposed at the moisture-proof wrapping operation 22, and a count value W3 at the counting sensor 84 disposed at the box packing operation 24 agree with each other.

In this manner, whether or not there is any missing product at the respective operations can be grasped with certainty.

While, at the cutting and collection control device 72, when the X-ray film sheets 12 produced through cutting at the cutting section 20A are conveyed on the sorting and conveying line 30, flow of the X-ray film sheets 12 is checked by the film detection sensors 60. Specifically, at the cutting and collection control device 72, results of detection by the film detection sensors 60A to 60I disposed at the defective sheet gate 48, the collection gate 50 and the sample gate 52 of the sorting and conveying line 30 are checked to confirm that the X-ray film sheets 12 are conveyed and collected with certainty without being lost.

Figure 4A:
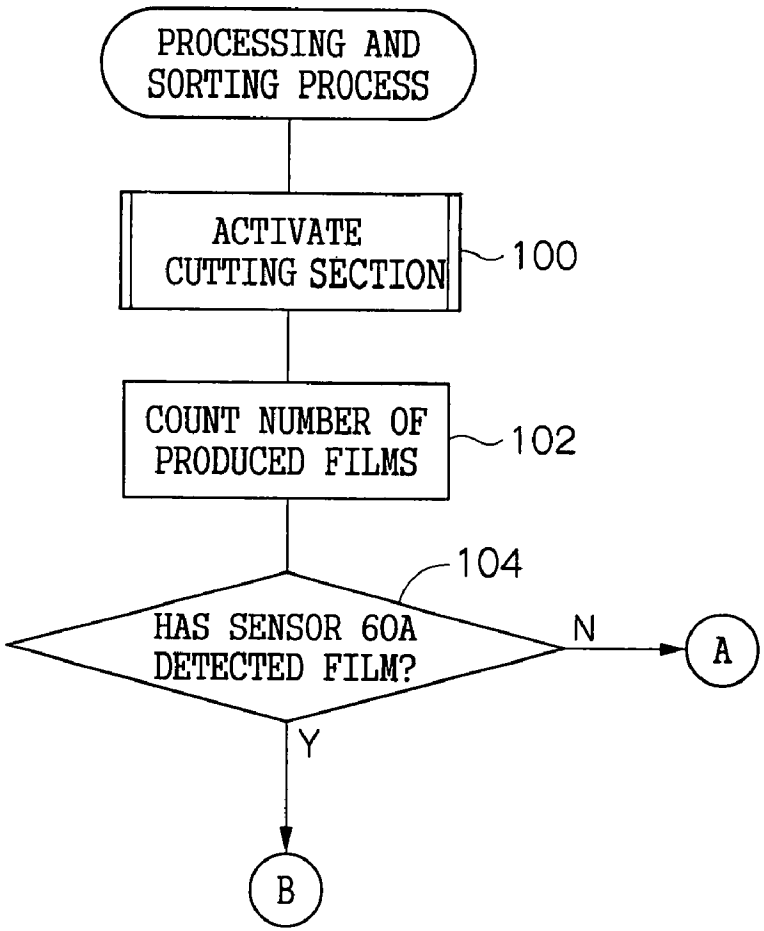
FIGS. 4A and 4B are flow charts showing an example of a sorting operation of X-ray film sheets using film detection sensors.
Figure 4B:
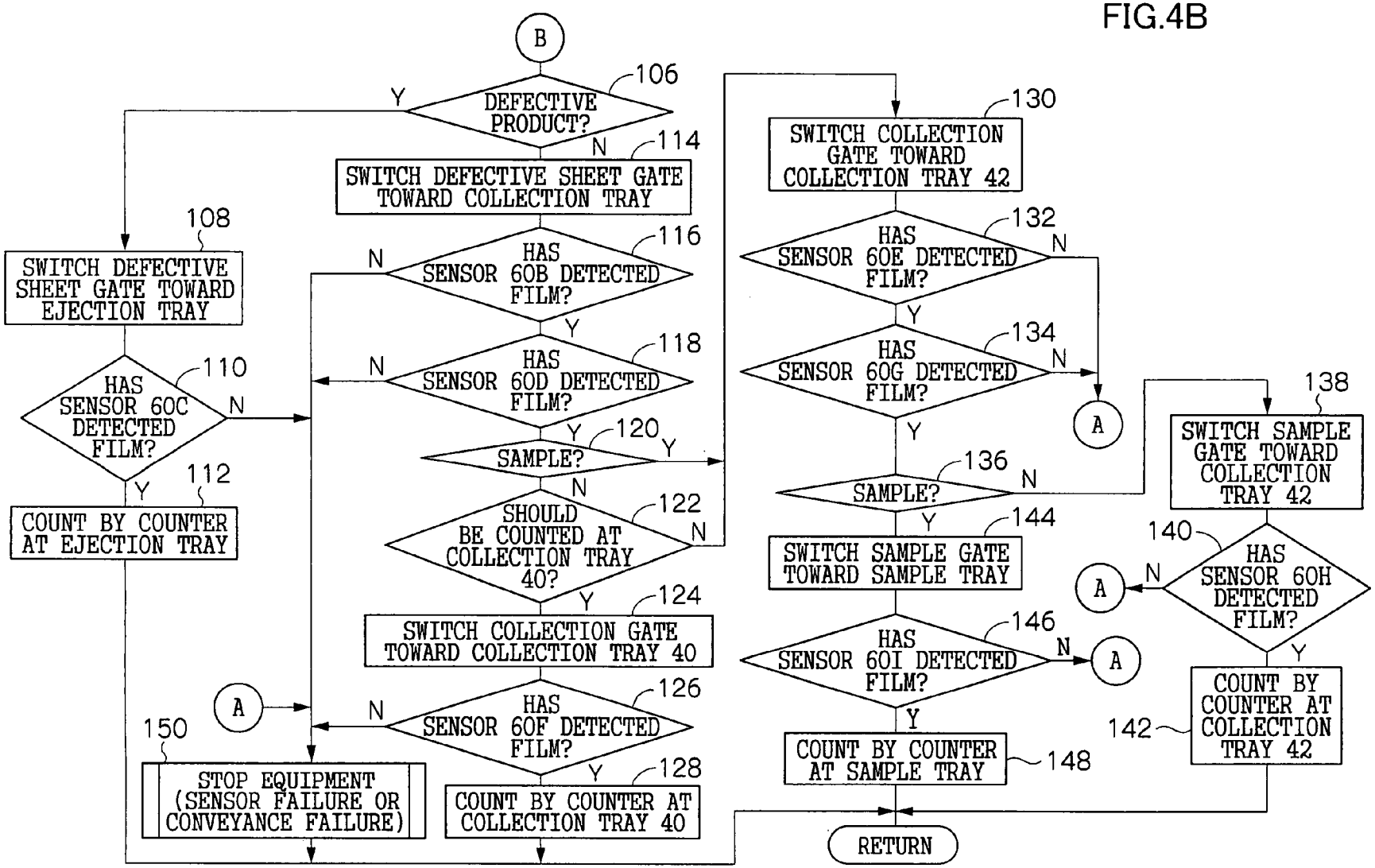

An outline of a process using the film detection sensors 60A to 60I is described with reference to flow charts shown in FIGS. 4A and 4B. It should be noted that, in FIGS. 4A and 4B, the X-ray film sheet 12 is referred to as "film", and the film detection sensors 60A to 60I are referred to as "sensors 60A to 60I".

In this flow chart, the first step 100 is performed at every time the cutting section 20A operates and the single X-ray film sheet 12 is produced from the X-ray film drawn from the roll 26. In step 102 next, the number of the produced X-ray film sheets 12 is counted. Conveyance of the produced X-ray film sheets 12 by the conveyer 54A of the sorting and conveying line 30 is started and the number of the X-ray film sheets 12 is counted using the film detection sensors 60A to 60I disposed along the sorting and conveying line 30.

The film manufacturing system 10 includes counters for counting the number of produced X-ray film sheets 12, as well as the numbers of the X-ray film sheets 12 collected respectively in the collection trays 40 and 42, the ejection tray 44 and the sample tray 46. Each counter is reset when the whole film is replaced (for example, if the roll 26 is the whole film, when a new roll 26 is loaded), and the count value at that time is tallied up by the manufacture control computer 78.

In step 104, whether or not the film detection sensor 60A has detected the X-ray film sheet 12 is determined. If the determination is affirmative, i.e., if the film detection sensor 60A has detected the X-ray film sheet 12, the counting process proceeds to step 106.

In step 106, whether or not the detected X-ray film sheet 12 is defective, for example, being a tip or tail portion of the roll 26, is determined.

If the X-ray film sheet 12 is defective, an affirmative determination is made in step 106 and the process proceeds to step 108, where the pivoting conveyer 56A at the defective sheet gate 48 is pivoted to switch the conveyance path of the X-ray film sheet 12 toward the ejection tray 44. Thus, the X-ray film sheet 12 is conveyed from the conveyer 54A toward the branch conveyer 58A.

In step 110 next, a determination is made as to whether or not the film detection sensor 60C, which is disposed at the defective sheet gate 48 at the branch conveyer 58A side thereof, has detected the X-ray film sheet 12 being conveyed toward the ejection tray 44. If the determination in step 110 is affirmative, i.e., if the film detection sensor 60C has detected passage of the X-ray film sheet 12, the process proceeds to step 112, where the counter provided for the X-ray film sheets 12 collected in the ejection tray 44 counts this X-ray film sheet 12. That is, the count value at the counter for the ejection tray 44 is incremented.

In contrast, if the X-ray film sheet 12 detected by the film detection sensor 60A is not defective, a negative determination is made at step 106 and the process proceeds to step 114, where the defective sheet gate 48 is switched toward the collection side (toward the conveyer 54B). Thus, the X-ray film sheet 12 is conveyed from the conveyer 54A to the conveyer 54B.

In step 116 next, a determination is made as to whether or not the film detection sensor 60B, which is disposed at the defective sheet gate 48 at the conveyer 54B side thereof, has detected passage of the X-ray film sheet 12. If the film detection sensor 60B has detected passage of the X-ray film sheet 12 and an affirmative determination is made in step 116, the process proceeds to step 118, where a determination is made as to whether or not the film detection sensor 60D, which is disposed at the entrance side of the collection gate 50, has detected the X-ray film sheet 12.

If the film detection sensor 60D has detected the X-ray film sheet 12, an affirmative determination is made in step 118, and the process proceeds to step 120. In step 120, a determination is made as to whether or not the X-ray film sheet 12 is a sample. If the X-ray film sheet 12 is not a sample, a negative determination is made in step 120, and the process proceeds to step 122. In step 122, a determination is made as to whether or not the X-ray film sheet 12 should be counted in the collection tray 40. That is, if the X-ray film sheet 12 is not a sample, a determination is made as to whether or not the X-ray film sheet 12 is collected in the collection tray 40.

If the X-ray film sheet 12 is to be collected in the collection tray 40, an affirmative determination is made in step 122, and the process proceeds to step 124. In step 124, the pivoting conveyer 56B at the collection gate 50 is pivoted toward the collection tray 40. Thus, the X-ray film sheet 12 is sent from the conveyer 54B to the branch conveyer 58B, and is collected from the branch conveyer 58B into the collection tray 40.

At this time, in step 126, a determination is made as to whether or not the film detection sensor 60F, which is disposed at the of the collection gate 50 at the branch gate 58B side thereof, has detected the X-ray film sheet 12. If the film detection sensor 60F has detected the X-ray film sheet 12, an affirmative determination is made in step 126, and the process proceeds to step 128. In step 128, the counter provided for the collection tray 40 counts this X-ray film sheet 12. That is, a count value at the counter provided for the collection tray 40 is incremented.

In contrast, if the X-ray film sheet 12 detected by the film detection sensor 60D is a sample (a determination in step 120 is affirmative), or the X-ray film sheet 12 is to be collected in the tray 42, not in the tray 40 (a determination in step 122 is negative), the process proceeds to step 130. In step 130, the pivoting conveyer 56B at the collection gate 50 is switched toward the conveyer 54C.

Thus, the X-ray film sheet 12 is sent from the conveyer 54B to the conveyer 54C.

At this time, in step 132, a determination is made as to whether or not the film detection sensor 60E, which is disposed at the exit side of the collection gate 50, has detected the X-ray film sheet 12. If the film detection sensor 60E has detected the X-ray film sheet 12, an affirmative determination is made in step 132, and the process proceeds to step 134. In step 134, a determination is made as to whether or not the film detection sensor 60G, which is disposed at the entrance side of the sample gate 52, has detected the X-ray film sheet 12.

If the film detection sensor 60G has detected the X-ray film sheet 12, an affirmative determination is made in step 134, and the process proceeds to step 136. In step 136, a determination is made as to whether or not the X-ray film sheet 12 is a sample.

If the X-ray film sheet 12 is not a sample, and is to be collected in the tray 42, a negative determination is made in step 136, and the process proceeds to step 138. In step 138, the pivoting conveyer 56C at the sample gate 52 is pivoted toward the branch conveyer 58C. Thus, the X-ray film sheet 12 is conveyed from the conveyer 54C to the branch conveyer 58C, and is collected in the collection tray 42.

At this time, in step 140, a determination is made as to whether or not the film detection sensor 60H, which is disposed at the sample gate 52 at the branch gate 58C side thereof, has detected the X-ray film sheet 12. If the film detection sensor 60H has detected the X-ray film sheet 12, an affirmative determination is made in step 140, and the process proceeds to step 142. In step 142, a count value at the counter provided for the collection tray 42 is incremented. That is, the counter counts the X-ray film sheet 12 as being collected in the collection tray 42.

In contrast, if the X-ray film sheet 12 detected by the film detection sensor 60G is a sample, an affirmative determination is made in step 136, and the process proceeds to step 144. In step 144, the sample gate 52 is switched toward the sample tray 46 (toward the branch tray 58D).

Thus, the X-ray film sheet 12 is conveyed from the conveyer 54C to the branch conveyer 58D, and conveyed by the branch conveyer 58D to be collected in the sample tray 46.

At this time, in step 146, a determination is made as to whether or not the film detection sensor 60I, which is disposed at the sample gate 52 at the branch gate 58D side thereof where the X-ray film sheet 12 exits the gate, has detected the X-ray film sheet 12. If the film detection sensor 60I has detected the X-ray film sheet 12, an affirmative determination is made in step 146, and the process proceeds to step 148. In step 148, this X-ray film sheet 12 is counted by a counter provided for the sample tray 46.

At the cutting and collection control device 72, if the film detection sensors 60 (60A to 60I) do not detect the X-ray film sheet 12 at the timing, at which the X-ray film sheet 12 is supposed to be detected, a determination is made as to if any failure has occurred with respect to the X-ray film sheet 12 or to the conveyance of the X-ray film sheet 12.

Specifically, if the film detection sensor 60A does not detect the X-ray film sheet 12 which has been cut at the cutting section 20A and began to be conveyed by the conveyer 54A, it is determined that some failure has occurred to the film detection sensor 60A or that the X-ray film sheet 12 has not been appropriately conveyed and the film detection sensor 60A could not detect the X-ray film sheet 12. Therefore, a negative determination is made in step 104, and the process proceeds to step 150, where the equipment (including the apparatus for processing the X-ray film sheet 12) is stopped.

Further, if the film detection sensor 60C does not detect the X-ray film sheet 12 even when an appropriate time for detection has past, a negative determination is made in step 110, and the process proceeds to step 150. In addition, if the film detection sensor 60B does not detect the X-ray film sheet 12 even when an appropriate time for detection has past (a determination in step 116 is negative), or the film detection sensor 60D does not detect the X-ray film sheet 12 (a determination in step 118 is negative), the process also proceeds to step 150.

Furthermore, if any of the film detection sensors 60E to 60I do not detect the X-ray film sheet 12 at appropriate times for detection, a negative determination is made at any of steps 132, 126, 134, 140 and 146, and the process also proceeds to step 150.

In the film manufacturing system 10, if the system is stopped due to the film detection sensors 60A to 60I failing to detect the X-ray film sheet 12, count values at the counters provided for the collection trays 40 and 42, the ejection tray 44 and the sample tray 46 are checked against the number of produced X-ray film sheets 12.

This check is effected in the following manner. For example, where the number of produced X-ray film sheets 12 is represented by Tp, and the numbers (count values at the counters) of X-ray film sheets collected in the collection trays 40 and 42, in the ejection tray 44 and in the sample tray 46 are receptively represented by T1, T2, Td and Ts, the checking result C is:

$$C=Tp-(T1+T2+Td+Ts)$$

If the result of the comparison C=0, the result of count can be determined as being correct. If the result of the comparison C≠0, it can be determined that there is excess or deficiency in the collected X-ray film sheets 12.

In the film manufacturing system 10, the equipment is quickly stopped when a possibility of abnormality occurs in the result of count. This significantly facilitates searching the cause of abnormality and correcting the result of collection due to the abnormality. This also significantly facilitates searching the missing X-ray film sheet 12, as one can know where, among the film detection sensors 60A to 60I, the abnormality has occurred when there is a deficiency in the count of the X-ray film sheet 12.

Therefore, down time of the equipment becomes minimum, and this can prevent productivity of the X-ray film sheets 12 from being impaired or lowered.

Further, in the film manufacturing system 10, the numbers of X-ray film sheets 12 collected in the collection trays 40 and 42, the ejection tray 44 and the sample tray 46 can be exactly counted. This enables efficient and appropriate production control.

Specifically, in the film manufacturing system 10, the counting sensors 80, 82 and 84 are provided respectively at the cutting and collecting operation 20, the moisture-proof wrapping operation 22 and the box packing operation 24, and the numbers of products at the respective operations can be counted.

The numbers of products at the respective operations are determined by the amounts of the X-ray film sheets 12 collected in the collection trays 40 and 42 at the cutting and collecting operation 20, and the numbers of X-ray film sheets 12 collected in the trays 40 and 42 can be exactly counted.

Thus, by checking the result of collection in the collection trays 40 and 42 against the numbers of products at the respective operations, it can be determined if the collected X-ray film sheets 12 are properly productized (packaged for shipment). Specifically, the number of the blocks 12A of the X-ray film sheets 12 produced at the cutting and collecting operation 20 can be found based on the amount of the X-ray film sheets 12 collected in the collection trays 40 and 42, and this number and the actual number of the blocks 12A of the X-ray film sheets 12 counted by the counting sensor 80 are compared with each other to determine whether or not there is a deficiency in the produced blocks 12A.

Further, by comparing the count results by the counting sensor 80 and the counting sensor 82 at the moisture-proof wrapping operation 22, it can be determined whether or not there is a deficiency in the wrapped bodies 16 produced at the moisture-proof wrapping operation 22. By comparing the count results by the counting sensors 82 and 84, it can be determined whether or not there is a deficiency in the cartons 18 produced at the box packing operation 24.

In the film manufacturing system 10, by grasping proper amounts of the X-ray film sheets 12 collected respectively in the collection trays 40 and 42, the ejection tray 44 and the sample tray 46, production loss can be grasped based on the length of the X-ray film which has been fed from the roll 26. It should be noted that the length of the film can be calculated from the detection time of the X-ray film by the film detection sensor 62 and the rotation speed of the roll 26A.

Specifically, where a length of the film is Lt, a length of the single X-ray film sheet 12 is La, a number of the cartons of the packaged X-ray films 12 is B, a number of the X-ray film sheets 12 per carton (the number of collected sheets) is Tn, numbers of the X-ray film sheets 12 remaining in the collection trays 40 and 42 are respectively Ta and Tb, and numbers of the X-ray film sheets 12 collected in the ejection tray 44 and in the sample tray 46 are respectively Td and Ts, a loss length L1 is represented as:

$$L1=Lt-La\times(Ta+Tb+Td+Ts)-(La\times B\times Tn)$$

Therefore, a loss number Lm of the X-ray film sheets 12 can be grasped as:

$$Lm=L1/La$$

The loss length L1 and the loss number Lm include the X-ray films which are not collected in the collection trays 40 and 42 due to occurrence of failure, or the like, and therefore, loss in the X-ray film which did not become a sheet due to occurrence of failure, or the like, can also be grasped.

As described above, productivity of the X-ray film sheets 12 can be precisely grasped in the film manufacturing system 10.

It should be noted that the above-described embodiment of the present invention is not intended to limit the arrangement of the invention. For example, although the defective sheet gate 48, the collection gate 50 and the sample gate 52 are each provided with the film detection sensors 60 at the entrance and the exit sides thereof, and determinations are made on whether or not the respective sensors 60 properly detect passage of the X-ray film sheet 12 in this embodiment, the numbers of the X-ray film sheets 12 detected at the respective film detection sensors 60 may be counted, and a sum of the numbers of the X-ray film sheets 12 counted by the film detection sensors 60 at the entrance sides and a sum of the numbers of the X-ray film sheets 12 counted by the film detection sensors 60 at the exit sides may be compared with each other every time a predetermined number of X-ray film sheets 12 have been produced.

The numbers of the X-ray film sheets 12 detected by the respective film detection sensors 60 may be compared with each other using any method at any timing.

Further, although the three gates: the defective sheet gate 48, the collection gate 50 and the sample gate 52 are used as the branch gates in this embodiment, the number of the branch gates is not limited to three, and there may be one, two, four or more branch gates.

Furthermore, although the branch gates for branching the conveyance path of the X-ray film sheets 12 into two paths are used in this embodiment, one branch gate may branch into three or more paths, and in this case, each of the branch paths is provided with a film detection sensor 60, which serves as the sheet material detector.

It should be noted that, although the X-ray film sheet 12, which is a heat-developing photosensitive material for medical use, is used as an example of the sheet material in the embodiment described above, the sheet material may be a wet-developing X-ray film, or any photosensitive material such as a film or photographic paper, which may not be for medical use.

Besides photosensitive materials, OHP films and various papers can also be applied as the sheet material.

As described above, according to the present invention, sheet material detectors are provided at entrance and exit sides of each branch gate, and the results of detection by the sheet material detectors can be used to quickly detect occurrence of a failure.

Thus, post handling against a cause of the failure and the failure itself can be facilitated and smoothed.

What is claimed is:

1. A method for controlling manufacture of a sheet material cut into a plurality of sheets of predetermined size, in which the sheets or processed products of the sheets are manufactured by processing the sheets or performing predetermined operations on the processed products of the sheets at each of processing operations or processing sections provided at the processing operations while conveying the sheets along a predetermined line, the method comprising:

cutting the sheet material into the plurality of sheets of predetermined size;

detecting passage of the sheets or the processed products of the sheets by sheet detectors disposed at entrance and exit sides of each of the processing operations or the processing sections where the sheets or the processed products of the sheets enter and exit the processing operations or the processing sections; and controlling conveyance or manufacture of the sheets or the processed products of the sheets based on results of detection by the sheet detectors, wherein each of the processing operations or the processing sections comprises a branch path for sorting the sheets or the processed products of the sheets being conveyed, and the sheet detectors are disposed at an entrance side and exit sides of the branch path, and wherein the controlling further comprises stopping conveyance or manufacture of the sheets or the processed products of the sheets if passage of the sheets or the processed products of the sheets is not detected by a sheet detector at one of the exit sides of the branch path toward which the sheets or the processed products of the sheets are conveyed, after a predetermined time after another sheet detector at the entrance side of the branch path detects the passage of the sheets or the processed products of the sheets.

2. The method according to claim 1, further comprising:

calculating a number of the plurality of sheets into which the sheet material is cut;

calculating a number of the sheets or the processed products of the sheets at each of terminal ends of the branch path; and comparing the number of the plurality of sheets and the number of the sheets of the processed products of the sheets when conveyance or manufacture of the sheets or the processed products of the sheets is stopped.

3. A method for controlling manufacture of a sheet material cut into a plurality of sheets of predetermined size applied to a manufacturing line including an operation section for performing a predetermined operation on the sheets while conveying the sheets along a predetermined conveyance path, the method comprising:

cutting the sheet material into the plurality of sheets of predetermined size;

detecting passage of the sheets by sheet detectors respectively disposed at entrance and exit sides of the operation section where the sheets enter and exit the operation section; and controlling conveyance or manufacture of the sheets based on results of detection by the sheet detectors, wherein the operation section comprises a branch path for sorting the sheets being conveyed, and the sheet detectors are disposed at an entrance side and exit sides of the branch path, and wherein the controlling further comprises stopping conveyance or manufacture of the sheets if passage of the sheets is not detected by a sheet detector at one of the exit sides of the branch path toward which the sheets are conveyed, after a predetermined time after another sheet detector at the entrance side of the branch path detects the passage of the sheets.

4. The method according to claim 3, wherein the predetermined operation comprises sorting the sheets.

5. The method according to claim 3, further comprising:

calculating a number of the plurality of sheets into which the sheet material is cut;

calculating a number of the sheets at each of terminal ends of the branch path; and comparing the number of the plurality of sheets and the number of the sheets when conveyance or manufacture of the sheets is stopped.

6. A method for controlling manufacture of a sheet material cut into a plurality of sheets of predetermined size applied to a manufacturing line including an operation section for performing a predetermined operation on the sheets while conveying the sheets along a predetermined conveyance path, the method comprising:

cutting the sheet material into the plurality of sheets of predetermined size;

detecting passage of the sheets sheet detectors respectively disposed at entrance and exit sides of the operation section where the sheets enter and exit the operation section; and controlling conveyance or manufacture of the sheets based on results of detection by the sheet detectors, wherein the operation section includes a sorting section for sorting the sheets and conveying and collecting the sheets into different collection sections, the sorting section including a sheet conveyance path with at least one branch gate, the at least one branch gate operating so as to direct a sheet conveyed thereto to one of different paths therefrom;

sheet detectors are disposed at entrance and exit sides of the at least one branch gate for detecting a sheet that passes through or has passed through the at least one branch gate;

the controlling step includes determining a conveyance status of the sheet based on results of detection by the sheet detectors;

a determination is made as to whether or not any failure has occurred in at least one of conveyance and sorting of the sheets, and whether the failure occurs when a sheet detector disposed at one of the exit sides of the branch path toward which the sheet is conveyed does not detect the sheet in a predetermined time after another sheet detector disposed at the entrance side of the branch path detects the sheet; and the manufacturing line is controlled so as to stop conveyance of the sheets based on the determination of the failure.

7. The method according to claim 6, wherein one of the collection sections is disposed, together with a counter for counting a number of the sheets collected at the respective collection section, at each of terminal ends of the branch paths, the sheets being produced by cutting to predetermined lengths a long material wound in a roll, the method further comprising calculating a number of produced sheets based on a length of the material drawn out from the roll, and comparing a number of the sheets collected in the collection sections with the calculated number of produced sheets when conveyance of the sheets is stopped.

8. The method according to claim 6, wherein at least one of the paths branched from the at least one branch gate directs the sheet toward a next branch gate.

9. The method according to claim 6, wherein at least one of wrapping and packaging the collected sheets is carried out to provide wrapped and/or packaged sheets, the method further comprising the steps of counting a number of sorted sheets and the numbers of at least one of the wrapped and packaged sheets, respectively, and comparing the number of sorted sheets and the number of the at least one of wrapped and packaged sheets when conveyance of the sheets is stopped.

* * * * *